United States Patent [19]

Chang

[11] Patent Number: 4,773,787

[45] Date of Patent: Sep. 27, 1988

[54] BINDING DEVICE FOR HOLDING LOOSE-LEAF PAPERS

[76] Inventor: Sun L. Chang, No. 10, Yi Hsin Rd., Tai Ping Hsiang, Taichung Hsien, Taiwan

[21] Appl. No.: 110,210

[22] Filed: Oct. 19, 1987

[51] Int. Cl.[4] ..... B42F 3/00

[52] U.S. Cl. ..... 402/60; 281/15 R; 281/25 A; 402/80 R; 412/39

[58] Field of Search ..... 281/21 R, 21 A, 25 R, 281/25 A, 2, 5, 15 R, 29, 38; 402/60, 68, 4, 79, 80 R, 80 P; 412/34, 39, 40

[56] References Cited

U.S. PATENT DOCUMENTS 1,556,049 10/1925 Trussell ..... 402/60

2,139,480 12/1938 Young ..... 402/60 X 2,463,946 3/1949 Brook ..... 402/60

*Primary Examiner*—Paul A. Bell

*Attorney, Agent, or Firm*—Poms, Smith, Lande & Rose

[57] ABSTRACT

A binding device for holding loose-leaf papers comprises a binder folded by a flexible material to form of a plurality of openings each constructed by two circumferential hooks, an engageable strip and two ended envelopes. The binder passes through a number of holes punched on each loose-leaf paper and the openings are faced outwardly. The longitudinal strip has two parallel longitudinal slots for corresponding to the hooks of the binder so that the binder can be engaged with the engageable strip. After that, the ended envelopes envelop on either end of the strip to prevent the strip from sliding.

1 Claim, 6 Drawing Sheets

BINDING DEVICE FOR HOLDING LOOSE-LEAF PAPERS

BACKGROUND OF THE INVENTION

This invention relates to a binding device for holding loose-leaf papers, particularly to a binding device which comprises a binder with a plurality of double-lined C-type openings and an engageable strip, by means of which a number of loose-leaf sheets punched with corresponding number of holes can be easily and efficiently bound together or detached off.

Nowadays, the means often used to bind loose-leaf papers are flexible plastic longitudinal binders 50, one side thereof extended a number of strips 501, as shown in FIG.5A, which they can be curled and inserted by a machine through the holes 41' on the loose-leaf papers 4' which are to be bound (shown in FIG. 5B).

While, the binder 50 has disadvantages in use. First, when an external force is applied on the binder 50, it is quite easily to be deformed. Second, because the binder 50 is curled and inserted by a machine into the punched holes 41' of the loose-leaf papers 4', it is not convenient to detach the binder 50 off the loose-leaf paper 4' frequently; i.e. the loose-leaf paper notebook or papers are not easly to be detached or to be added new ones.

There is another binder in the market as shown in FIG. 6. The binder 60 is a wire made of metal, which is formed of a plurality of double-lined openings 61 each constructed by two arc-like hooks 62 which are folded by a flexible metal. When binding a number of loose-leaf papers 4'' with the arc-like hooks 62 of the openings 61 passing through the punched holes 41'' of the loose-leaf papers 4'', the opening 61 are appeared outsides. Then the binder 6 is pressed by a machine to make the opening 61 nearly closed to avoid the papers slipping off.

But there are also some disadvantages. For example, once the user wishes to detach the desired-papers or add new ones, it is necessary for him or open the openings 61 by means of an auxiliary machine. In addition, the fastened extend of the openings 61 are not absolutely closed, therefore, it still be easily to be deformed and also, the circumference of the openings 61 easily cut the hand of the user.

Because of the drawbacks stated above, the creator of this invention has designed a binding device, which comprises a binder with a plurality of openings folded by a flexible material, an engageable strip and two ended envelopes, thereby obviating and mitigating the above-mentioned disadvantages of the prior art.

This invention will be best understood from a consideration of the following detailed description in view of the accompanying drawings forming a part of the specification.

SUMMARY

A primary object of this invention is to provide a binding device which is convenient to detach or add new loose-leaf papers by manual method.

A second object of this invention is to provide a binding device which comprises a hard, strong, shape-fixed strip so that it can suffer larger pressure and not easiliy be deformed.

Another object of this invention is to provide a binding device comprising a flat strip which engages with a binder and covers the spine of a note-book, two ended envelopes being set on two ends of the flat strip, so that the strip can be written with a sign or words for files and the envelopes can protect the ends of the notebook.

Further objects and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
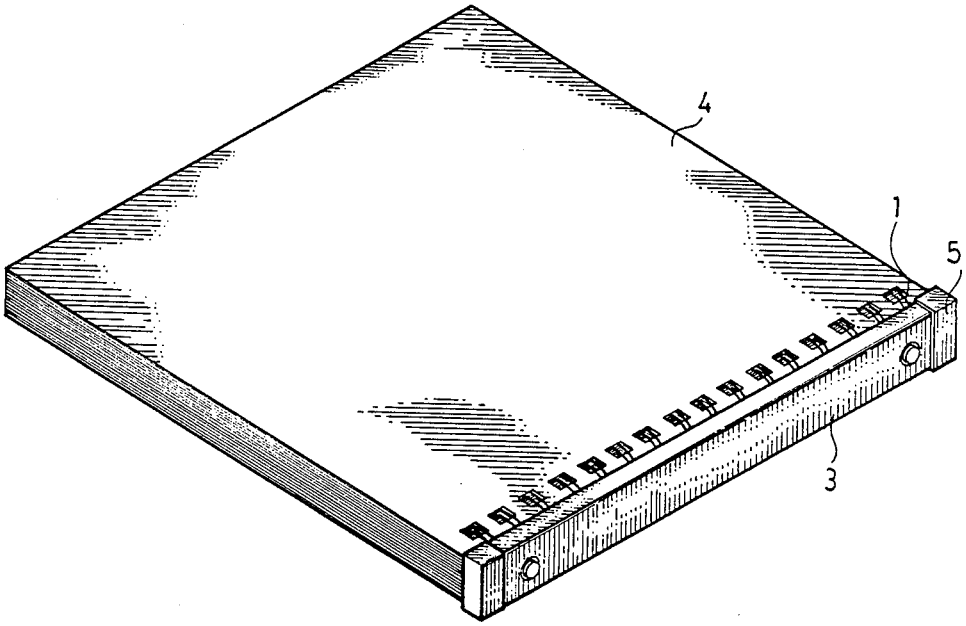
FIG. 1 is an embodiment showing a number of the loose-leaf paper are bound together in accordance with this invention.
Figure 2:
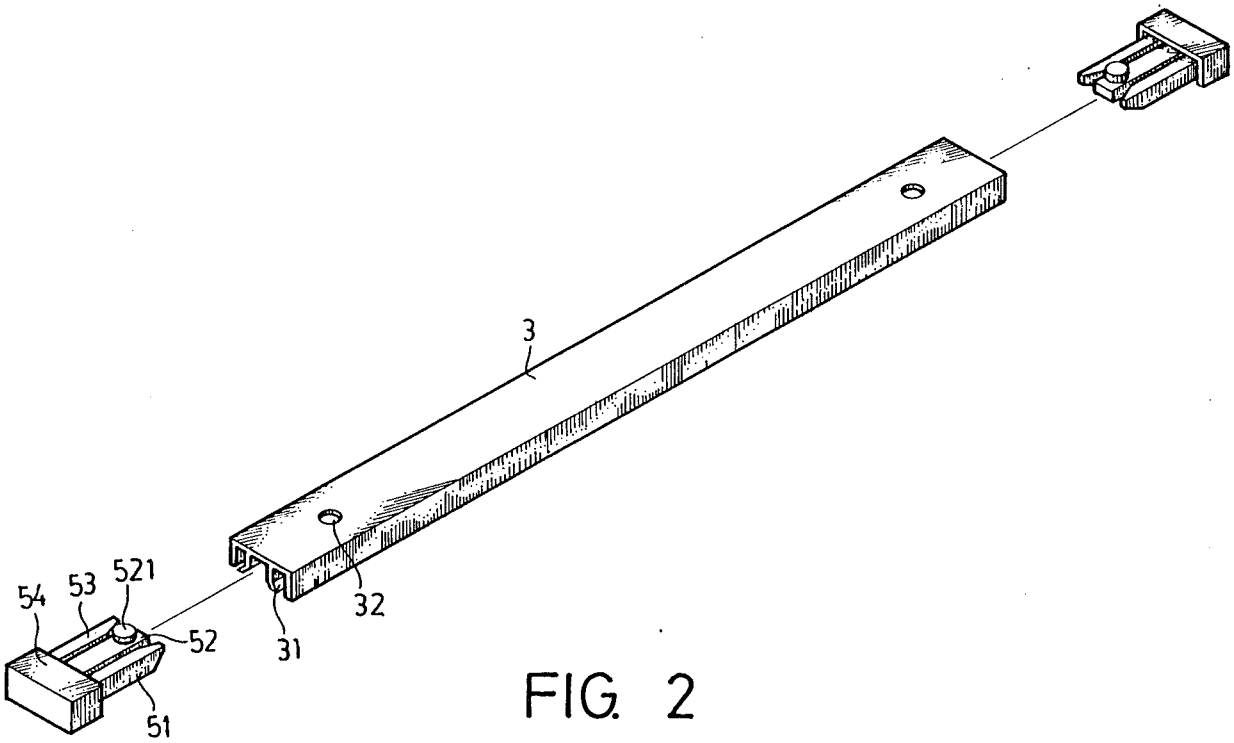
FIG. 2 shows an exploded view of this invention.
Figure 3:
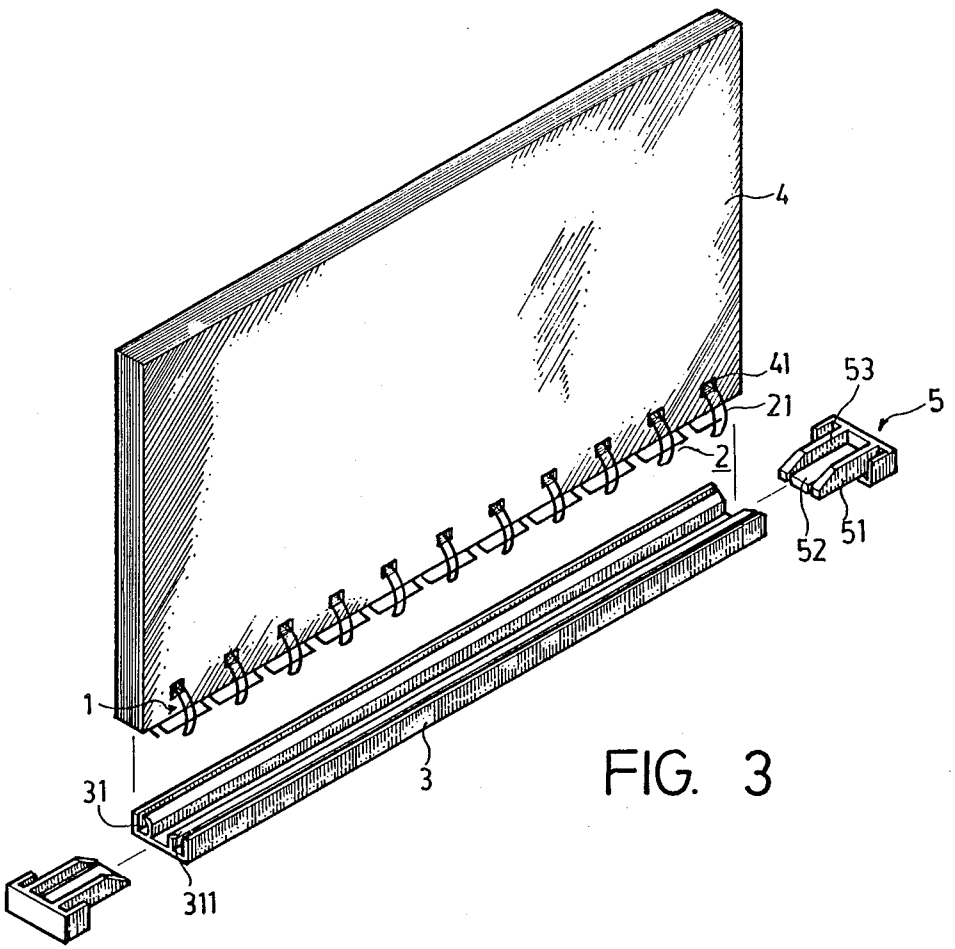
FIG. 3 shows an exploded view of this invention viewing from the top thereof and by accompanied with its embodiment.
Figures 6A, 6B:
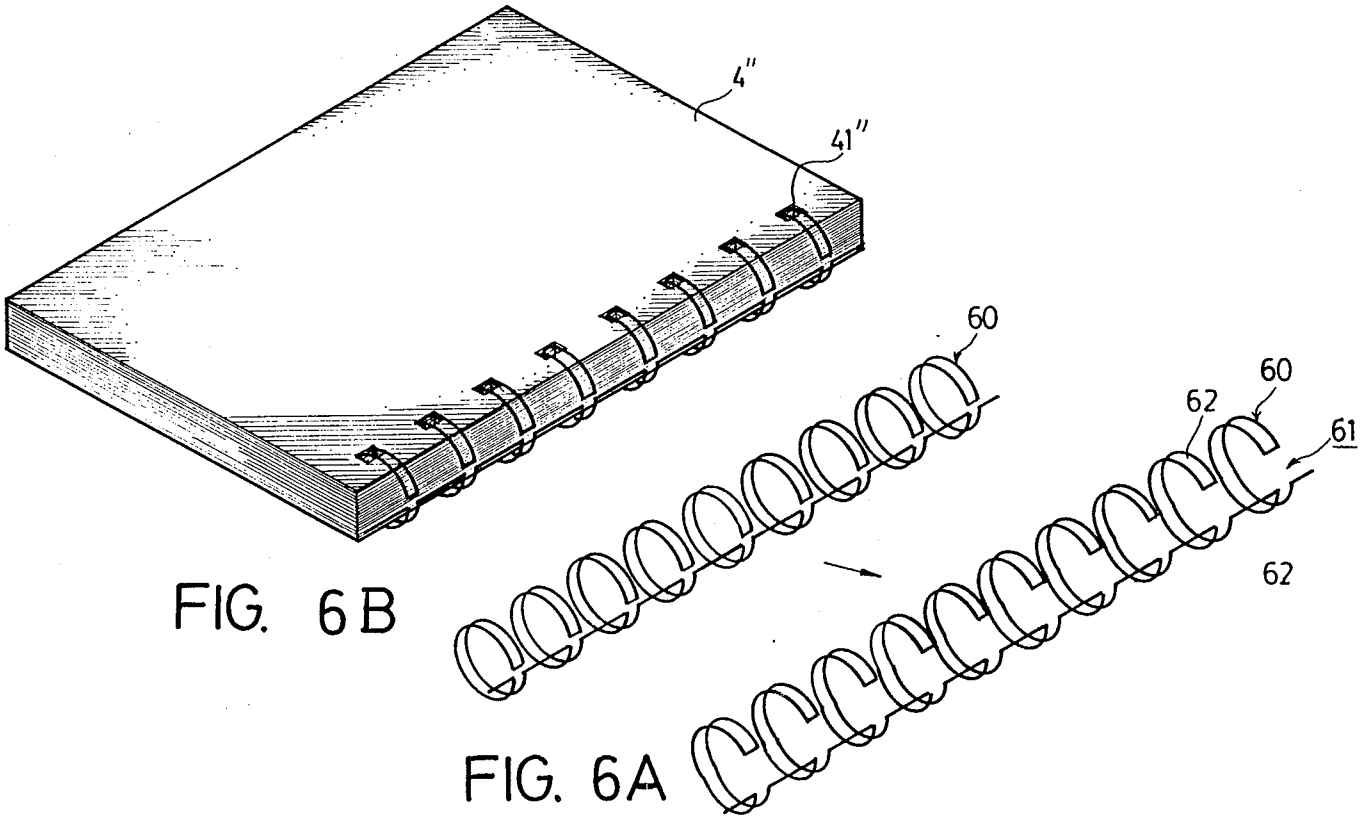
FIG. 6A and FIG. 6B show another prior art and its accompanying embodiment, reapectively.

Referring to FIG. 1, FIG. 2 and FIG. 3, it can be seen that the binder 1 is the same as that of the prior art shown in FIG. 6A which is folded by a flexible material to form a plurality of openings 2 each constructed by non-symmetry and unequal sized arc-like hooks 21. An engageable strip 3 has a smoothed surface and an inner face thereof are set two longitudinal slots 31 so that the hooks 21 of the binder 1 can slide through each slot 31.

Figure 4:
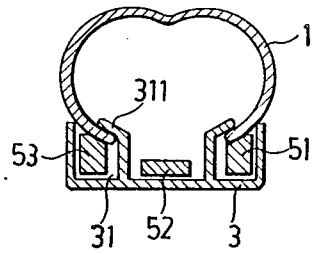
FIG. 4 is a sectional view showing engaged condition of the binder and the engageable strip of this invention.
Figures 5A, 5B:
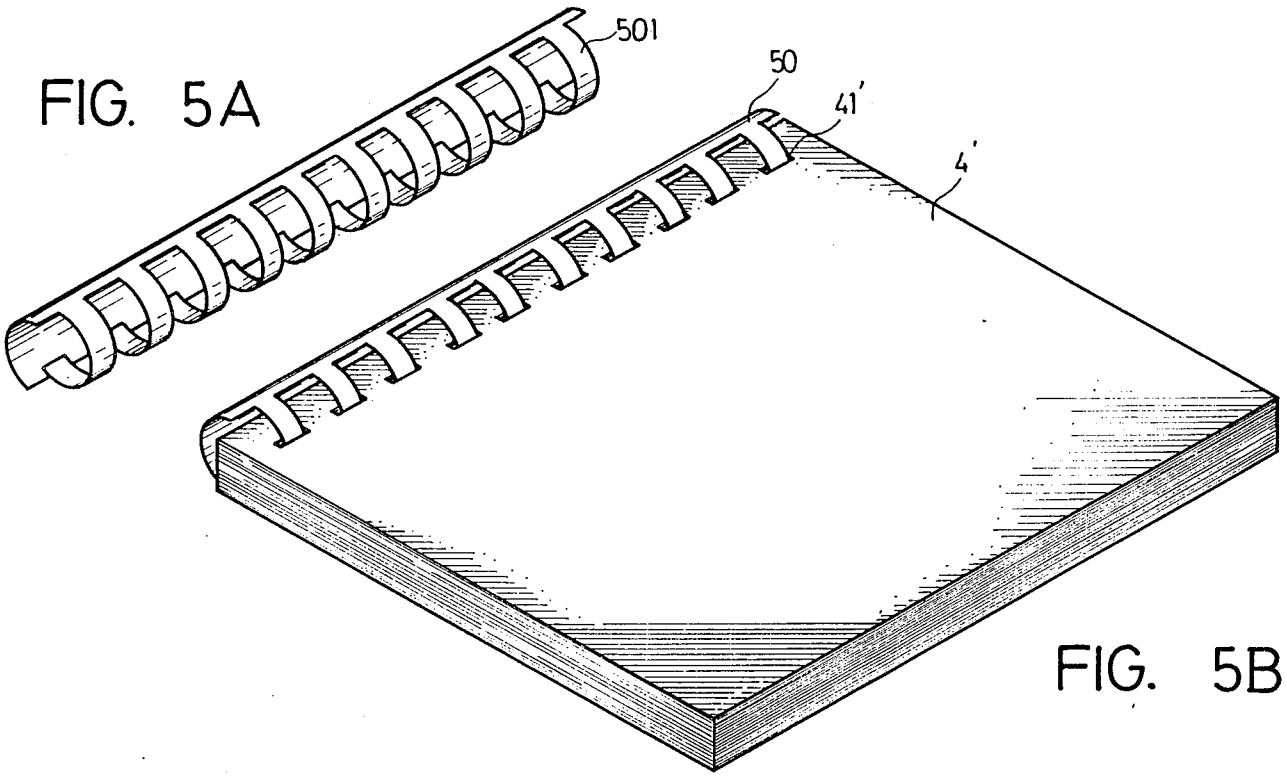
FIG. 5A and FIG. 5B show a prior art and its accompanying embodiment, respectively.

Each slot 31 is made with an inclined portion 311 on the top thereof so that the width of the upper of the slot 31 is smaller and which can easily hold the hooks 21 therein. When the binder 1 is passed through a number of punched holes 41 of loose-leaf paper and the engageable strip 3 and the binder 1 are engaged together, two ended envelopes 5 then envelope on each end of the strip 3. The ended envelopes 5 comprises three legs 51, 52, 53 extending from the top cover 54 thereof and the length of the leg 52 is so long that a circular protuberance 521 on the leg 52 can be passed through a corresponding hole 32 of the strip 3. Once the user hope to detach the envelope 5, he should press the protuberence 521 and pull the protuberence 521 out, then the envelope 5 is separated from the strip 3. The top cover 54 also be enveloped onto the end of the strip 3 and be supported by the end of the strip 3. Especially note that the other two legs 51, 53 is made slightly inclined inwardly; therefore, as shown in FIG. 4, when the ended envelope 5 is enveloped into the slots 31 of the strip 3, the end of the binder 1 will be engaged and retained between the upper inclined portion 311 of the slot 31 and the leg 51 (or 53), so that the binder 1 can be fixed on the slot 31 and will not be slipping freely.

Because the strip 3 is easily slided off or slided on the binder 1, the loose-leaf papers or notebooks 4 are no doubt to be detached or added new ones conviently from the openings 2 of the binder 1. Further, as the strip 3 is made of hard material and which has a fixed shape so that a loop-leaf notebook or a plurality of loose-leaf papers bound by the binding device of this invention will not be pressed to deform the original shape of the binding device.

Further, the engageable strip 3 is made a flat outer suface so that it can be written with a sign or words for files storage.

Accordingly, this invention is provided with a very simple, convient, heavily defended binding device. It is apparent that this invention is not confined to the disclosure, being susceptible of such changes and modifications which shall define no material departure from the salient features of the invention as expressed in the appended claims.

I claim:

1. A binding device for holding loose-leaf papers comprising a binder which is folded by a flexible material to form of a plurality of double-lined openings each constructed by two arc-like hooks and appeared outwardly when said binder is passing through the loose-leaf papers, an engageable strip including a flat outer surface and an inner face, and two ended envelopes; said inner face of said engageable strip having two slots, each of said slots having an inclined portion on the top thereof and said hooks of said binder being engageable with said two slots; said ended envelopes each having a middle leg and two sided legs extending from a top cover thereof wherein said middle leg is so long that said middle leg is passed through a hole of said strip; the two sided legs of said envelope each is made to have an inclined end; when said strip is engaged with said hooks of said binder, enveloping each ended enveloped on either end of said engageable strip and said hooks of said binder being engaged and retained between said slots and said sided legs so as to prevent said strip from sliding.

* * * * *